US005515761A

United States Patent [19]

Sides

[11] Patent Number: 5,515,761

[45] Date of Patent: May 14, 1996

[54] STABILIZER FOR TREMOLO BRIDGE

[76] Inventor: Frank T. Sides, 7011 Collins Ave., Pennsauken, N.J. 08109

[21] Appl. No.: 346,743

[22] Filed: Nov. 30, 1994

[51] Int. Cl.[6] ..... G10D 3/00

[52] U.S. Cl. ..... 84/313

[58] Field of Search ..... 84/313, 267, 298, 84/299, 312 R

[56] References Cited

U.S. PATENT DOCUMENTS 4,763,555 8/1988 Minakuchi et al. ..... 84/313

*Primary Examiner*—Patrick J. Stanzione

*Attorney, Agent, or Firm*—Robert C. Podwil; Reed Smith Shaw & McClay

[57] ABSTRACT

A stabilizer for a tremolo bridge prevents disablement of an instrument in the event of string failure. An abutment, selectively actuated, serves to support and position a tremolo bridge so that pre-failure tuning of the remaining strings is maintained. A method is disclosed for stabilizing a tremolo bridge, comprising steps of determining the normal position of the bridge with strings intact and the tremolo not actuated, providing a retractable stabilizer capable of maintaining the bridge in that position, and selectively using the stabilizer to limit disabling movement of the tremolo bridge in the event of a string failure.

8 Claims, 4 Drawing Sheets

STABILIZER FOR TREMOLO BRIDGE

BACKGROUND OF THE INVENTION

This invention relates to tremolo devices for stringed instruments, such as guitars, and more particularly, to a method and apparatus for stabilizing a pivotable tremolo bridge so that an instrument equipped with such a device may continue to be played despite breakage of a string.

Guitars are sometimes equipped with so-called "tremolo" devices, which enable the player to selectively alter the tone of an instrument by changing the tension on all strings simultaneously. Familiar tremolo devices, which have been available on the market for many years, utilize a bridge plate, pivotably mounted on the body of the instrument. First ends of the respective strings are anchored to the bridge plate, and other ends of the strings are anchored to adjustable tuning pegs near the nut and remote from the body of the instrument.

In typical tremolo devices, such as those disclosed in U.S. Pat. No. 4,171,661, issued Oct. 23, 1979, to Rose and U.S. Pat. No. 4,892,025, issued Jan. 9, 1989, to Steinberger, the bridge plate of the tremolo device is arranged to pivot on an axis transverse to the direction of the strings. A bridge element mounted on the bridge plate engages the strings to create the desired change in string tension when tile player moves the tremolo actuating arm. A counter-spring is utilized to oppose and counteract the pull of the strings on the bridge plate.

A problem attendant the use of known tremolo devices arises with the breakage of a string. Because the tension of the strings is balanced by the above-mentioned counter-spring, loss of the force of one or more strings increases the tension on the remaining strings, causing them to go sharp, and allows the counter-spring to displace the bridge plate. The instrument thus becomes unplayable.

SUMMARY OF THE INVENTION

The present invention provides a stabilizer associated with the bridge plate of a tremolo device, operable by a guitarist while playing, in the event of string breakage. With the present invention, the remaining strings can quickly and reliably be restored to tune despite the breakage, and the tremolo device remains operable. Thus, the instrument remains usable, and the player can complete a piece of music using the intact strings.

In its apparatus aspect, the present invention relates to a stabilizer for a tremolo device which comprises a selectively adjustable abutment coupled to the bridge plate of a tremolo device, for normal movement with the bridge plate. The abutment is selectively operable by the player between a first, inoperative (retracted), position, and an engaged position in which it serves to stabilize the bridge plate. The abutment is selectively pre-adjustable to a condition in which its actuation stabilizes the bridge plate at a position providing for normal tune of the remaining strings despite the failure of any one or more strings. The abutment, in the preferred form of the invention, is a spring-urged pin, operable either directly or by a control spaced from the pin, to project the pin and lock it into a position in which it stabilizes the bridge plate. The apparatus includes a latch arrangement, coupled to the abutment, to maintain the abutment in the first position, and selectively operable latch means which allows the abutment to move from its first to its second position.

The stabilizing action of the present invention should be distinguished from the action of known tremolo locks, such as, for example, the one shown in U.S. Pat. No. 4,892,025. Such devices serve only to selectively disable the function of the tremolo device.

BRIEF DESCRIPTION OF THE DRAWINGS

There is seen in the drawings a form of the invention which is presently preferred (and which constitutes the best mode contemplated for carrying the invention into effect), but it should be understood that the invention is not limited to the precise arrangements and instrumentalities shown.

DETAILED DESCRIPTION OF A PREFERRED EMBODIMENT

Figure 1:
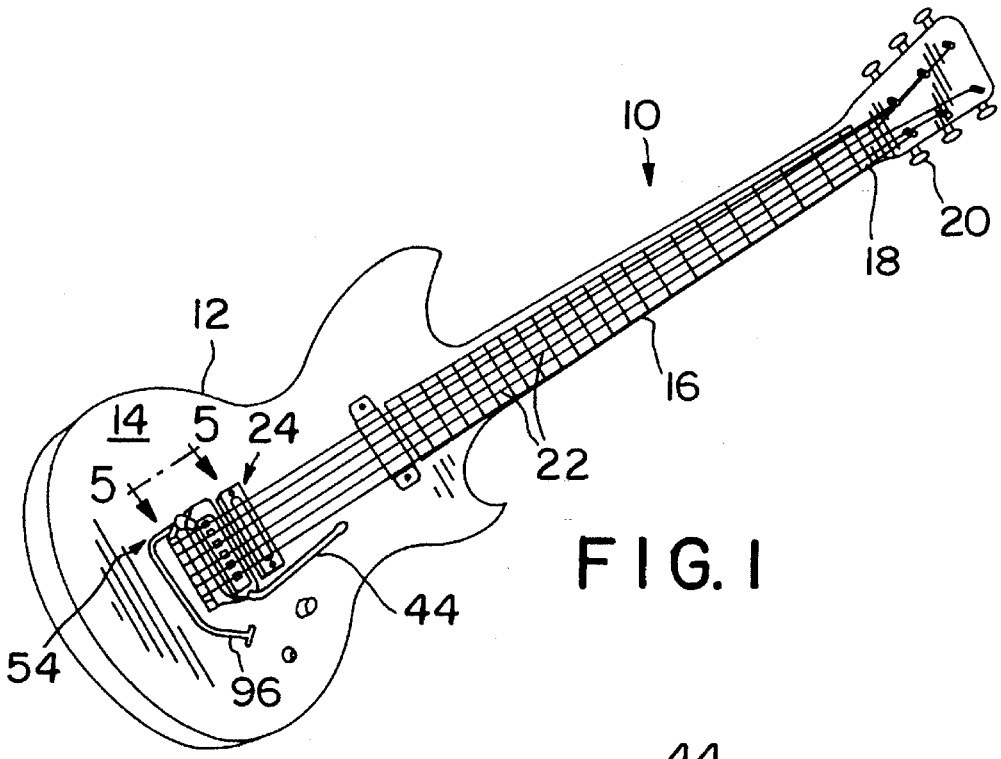
FIG. 1 is a pictorial view of a guitar utilizing the present invention.

Referring now to the drawings in detail, wherein like reference numerals indicate like elements, there is seen in FIG. 1 a guitar designated generally by the reference numeral 10. As is conventional, the guitar 10 consist of a body 12 having a sounding board or face 14. Attached to the body 12 is a neck 16, having a nut 18 and means 20 for a retaining and adjusting the pitch of the strings 22.

Figure 2:
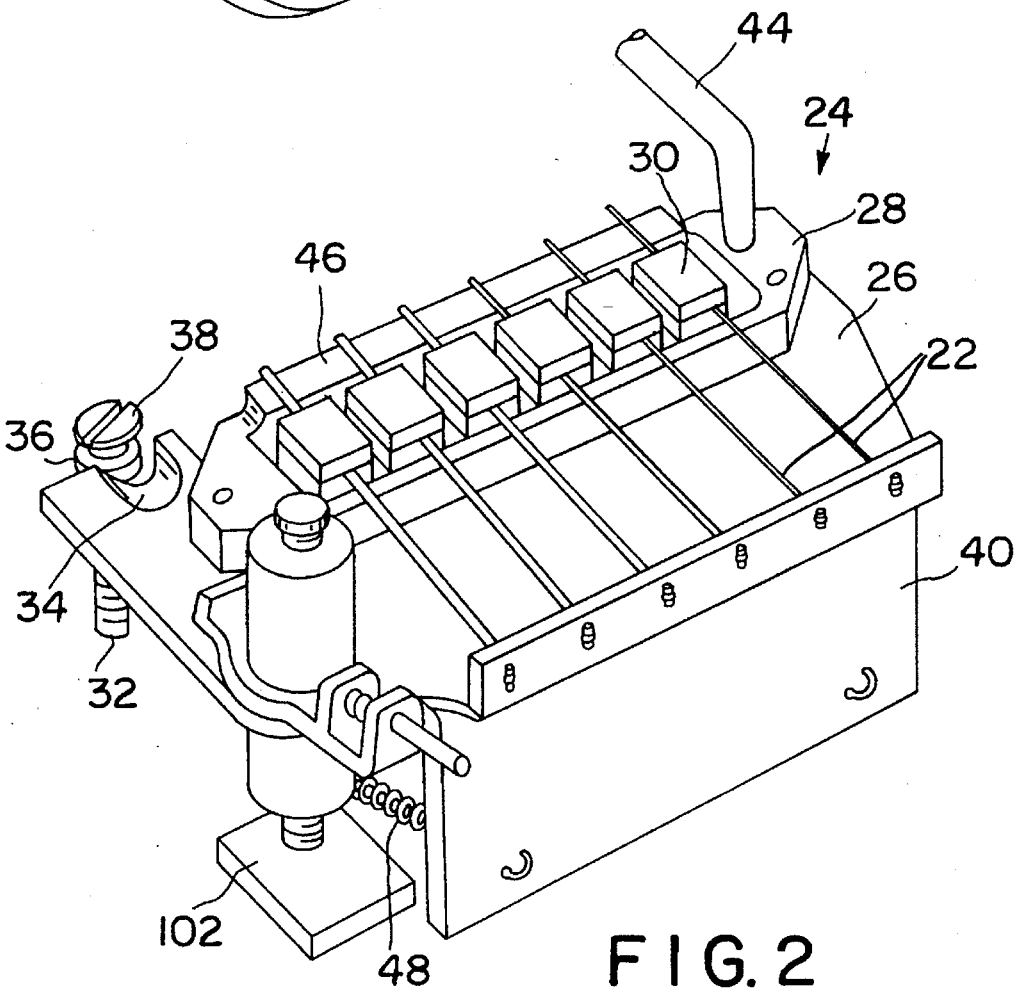
FIG. 2 is an enlarged perspective view of a tremolo device, provided with a stabilizer in accordance with the present invention.

A tremolo device, designated generally by the reference numeral 24, is secured to the face 14, and secures the bridge end of the strings 22. Referring now to FIG. 2, the tremolo device 24 includes a bridge plate 26, to which there is secured means 28 and 30 for securing the strings 22. Anchor screws 32 secured to the body 12, provide pivot points for the bridge plate 26. In this regard, referring to FIG. 2, the bridge plate 26 is provided with contoured slots 34, adapted to engage the anchor screws 32. The anchor screws 32 are typically provided with flanges 36, so that an edge of the contoured slot 34 may be received between the flange 36 and the head 38 of an anchor screw 32, thus providing a hinge for the bridge plate 26 relative to the face 14.

Figure 5:
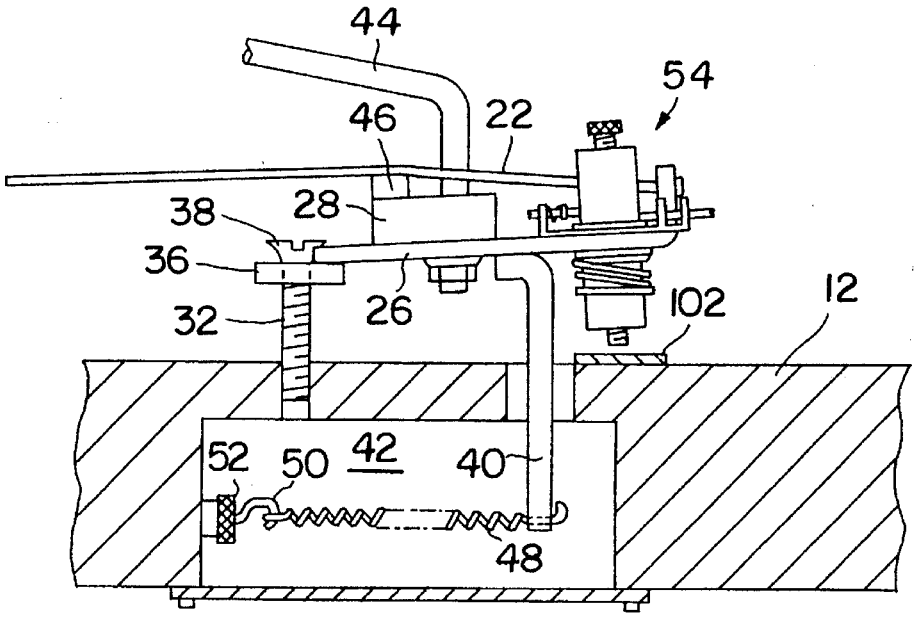
FIG. 5 is a partial sectional view taken along the line 5—5 in FIG. 1.

Referring now to FIG. 5, associated with the bridge plate 26 is a lower plate 40, which projects downwardly from the bridge plate 26 and extends into a recess 42 in the body 12 of the guitar 10.

A tremolo actuating arm 44 is secured to the bridge plate 26. Also secured to the bridge plate 26 is a bridge 46, which engages the strings 22. Movement of the actuating arm 44 it will now be seen, causes the bridge plate 26 to pivot relative to the anchor screws 32 and face 14. The bridge 46, causes such movement to vary the tension of all of the strings 22 to produce the desired tremolo effect.

A counter-spring 48 is provided within the recess 42, and coupled in tension, to the body 12 and lower plate 40. Means 50 may be provided to anchor one end of the counter-spring 48 to an anchor screw 52, associated with the body 12.

Figure 3:
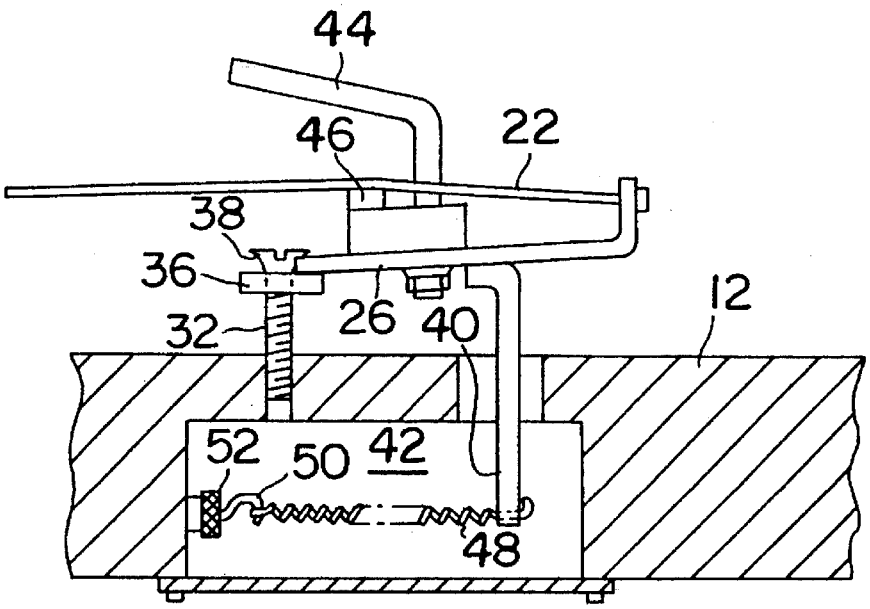
FIG. 3 PRIOR ART
FIG. 3 is a partial cross-sectional view showing a prior art tremolo device in an operative condition.
Figure 4:
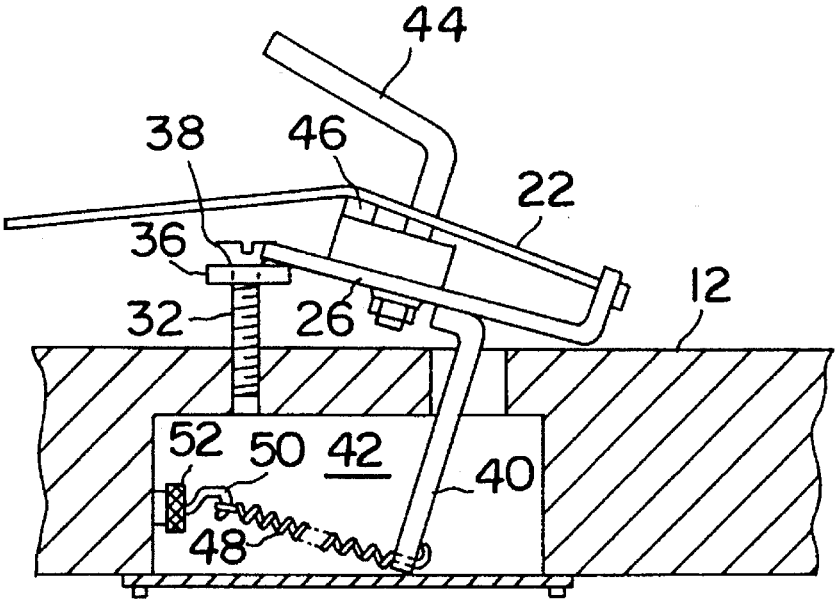
FIG. 4 PRIOR ART
FIG. 4 is a view similar to FIG. 3, but showing the result of a string failure.

The foregoing structure is conventional, and is also found in the prior art, depicted in FIGS. 3 and 4.

FIG. 4 illustrates the condition of a prior art tremolo device in the event of string failure. As can be seen, if failure of one or more of the strings 22 results in reduced force in opposition to the counter-spring 48, the counter-spring 48 causes the base plate 26 to rotate clockwise in the Figure, generally to the condition shown. In such a condition, the tension on the remaining strings, and therefore their pitch, is changed, and the instrument is no longer playable.

Figure 6:
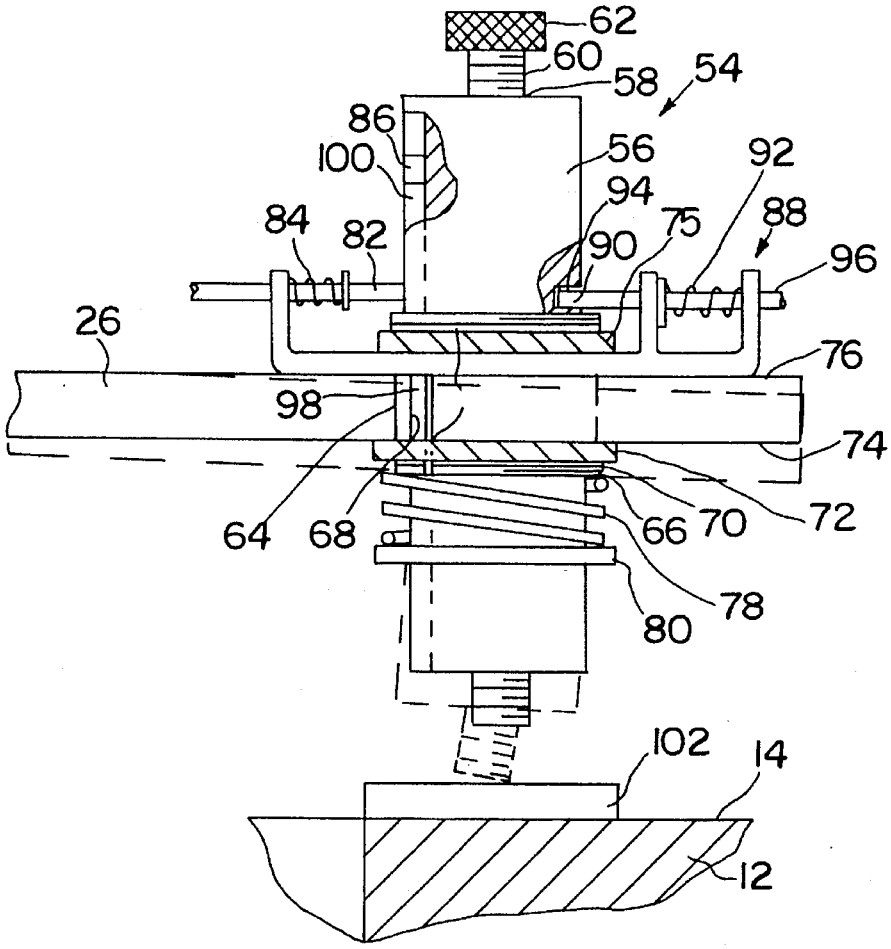
FIG. 6 is a detailed view, in cross-section, of a stabilizer device in accordance with the invention.
Figure 7:
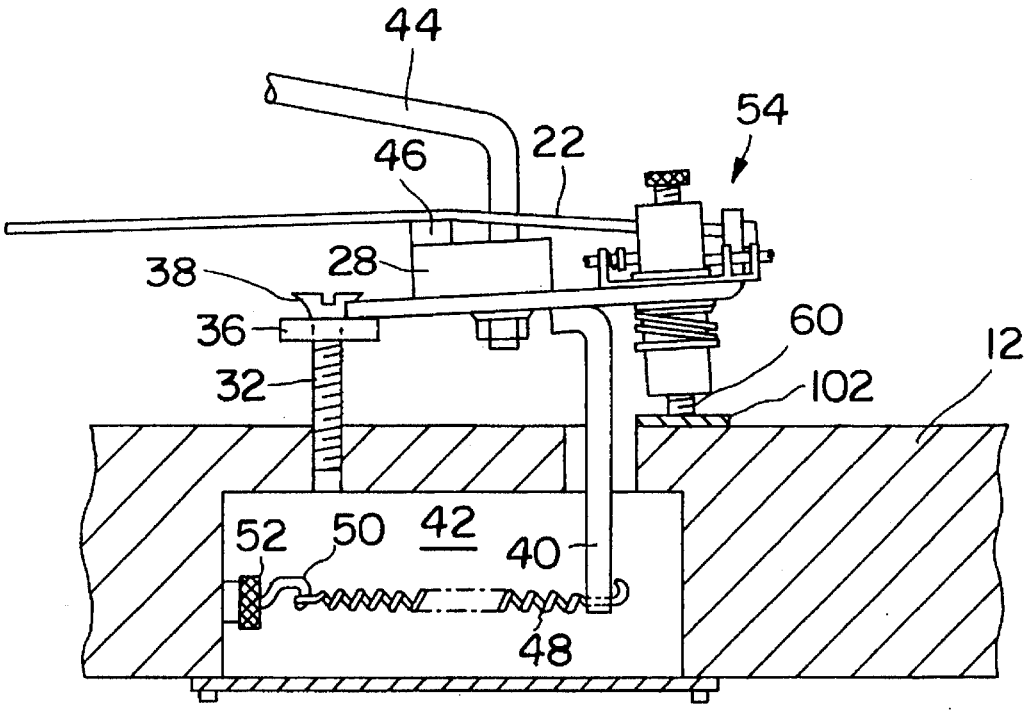
FIG. 7 is a partial cross-sectional view, showing the stabilizer in accordance with the invention in its operative, stabilizing, condition.

Referring now to FIGS. 6 and 7, a preferred form of the stabilizer device, in the form of a unit designated generally by the reference numeral 54, is shown in association with the bridge plate 26. The unit 54 includes a spring-urged pin 56, which will be described below in greater detail. The pin 56 is provided with a threaded bore 58, within which there is received an externally threaded stop bolt 60. The stop bolt 60 may advantageously be provided with a knurled head 62. Rotation of the stop bolt 60 by manipulation of the knurled head 62 serves to adjust the amount by which the stop bolt 60 projects from the pin 56.

The stabilizer unit 54 is mounted in a hole 64 in the bridge plate 26 (FIG. 6), provided for that purpose. The hole 64 may be drilled in an existing bridge plate 26, or provided at the time of manufacture. An externally threaded sleeve 66, provided with an internal bore 68 slightly greater than outer diameter of the pin 56, slidably receives the pin 56. External threads 70 of the sleeve 66 have a diameter slightly less than the diameter of the hole 64, so that the sleeve 66 with the pin 56 within it, may be received in the hole 64 as shown in FIG. 6. Referring now to FIG. 6, threaded ring 72, engagable with the threads 70 of the sleeve 66, abuts a lower surface 74 of the bridge plate 26. A threaded ring or ring-like fitting 75 is threadedly engaged with the sleeve 66, and when installed, abuts an upper surface 76 of the bridge plate 26. The threaded ring 72 and fitting 75, it will thus be seen, serve as opposed nuts to affix the sleeve 66 to the bridge plate 26. Small adjustments of the position of the sleeve 66 relative to the bridge plate 26 (and therefore of the position of the pin relative to the bridge plate 26) can be made by selective positioning of the threaded ring 72 and fitting 75.

A compression spring 78 may abut on the threaded ring 72 or on the lower surface 74 of the bridge plate 26, and also abuts a collar 80 affixed to the pin 56. Thus, it will be seen, the coil spring 78 normally biases the pin 56 downwardly in the Figure, for a purpose to be described. Those skilled in the art will appreciate that other equivalent structures, such as springs internally mounted within the pin 56 or other such mechanical arrangements, could be used to equal advantage.

Associated with the threaded fitting 75 as shown, or with the bridge plate 26, but in any event designed to interact with the pin 56, is a down limit stop 82, spring urged by means of the compression spring 84 to the "engaged" position. A groove 86 provides a detent or abutment adapted to receive the limit stop 82 as described below. Also associated with the pin 56 is a trigger device, designated generally by the reference numeral 88. The trigger device 88 in the illustrated form of the invention comprises a stop 90, normally urged by a compression spring 92, to a projected position in which it resides in a grove 94 in the body of the pin 56. The trigger device 88 may be remotely actuated, by means of a cable 96. Alternatively, the trigger device 88 may be arranged for local actuation.

Rotation of the pin 56 within the sleeve 66 is prevented by a key 98 or other abutment associated with the sleeve 66 and projecting into association with an axially extending groove 100 in the outer surface of the pin 56.

A metal striker plate 102 is affixed to the face 14 of the guitar body 12, for a purpose which will now be apparent.

The manner in which the stabilizer unit 54 may be mounted on a tremolo device 24 should now be apparent. The sleeve 66 is first mounted in the hole 64 in the bridge plate 26, and the threaded ring 72 and fitting 74 are secured. The striker plate 102 may be mounted on the face 14 beneath the bridge plate 26 and in opposition to the stabilizer unit 54.

Next, the pin 56 is slid into the sleeve 66 with its groove 100 in alignment with the key 98. The spring 78 is compressed as the pin 56 moves relative to the sleeve 66. The trigger device 88 (or latch) engages the stop 90 to retain the pin 56 in a fixed longitudinal position with respect to the sleeve 66.

The stabilizer unit 54 may now be adjusted or preset, as follows.

With the trigger 88 released, the coil spring 78 causes the pin 56 to move downwardly relative to the bridge plate 26, until the down limit stop 82 engages the abutment groove 86. In this position, the pin 56 is disposed as it would be in the event of actuation by an operator in response to a string failure. The stop bolt 60, can now be preset by turning the head 62 to project the stop bolt 60 sufficiently that it contacts the striker place 102 and the bridge plate 26 is supported in its normal position, that is, the position it normally takes with all strings intact and tuned, but without actuation of the tremolo device 24 by means of the actuator arm 44. During normal play of the instrument 10, the stabilizer unit 54 is maintained in a retracted condition (FIG. 5) in which the tremolo bridge plate 26 may be freely operated as if the stabilizer unit 54 were not present. The pin 56 is maintained in its inoperative condition by the trigger device 88. In the event of string failure, however, momentary actuation of the tremolo arm 44 followed by actuation of the trigger device 88 causes projection of the pin 56 under the urging of the spring 78 until such time as the down limit stop 82, under the influence of the spring 82, engages the abutment groove 86. In that condition, the stop bolt 60, in contact with the striker plate 102, prevents movement of the bridge plate 26 to the condition depicted in FIG. 3, and allows for continued playing of the instrument using the remaining strings 22.

It should be understood that in the event of string failure, the player can virtually instantaneously operate the tremolo arm 44 to counter the overbalancing effect of the counter-spring 48, and then trip the trigger device 88 to cause the pin 26 to move to the active stabilizing position, as described above.

In its method aspect, the present invention comprises steps of determining the position of the tremolo bridge in its normal inactive position with strings intact and in tune; providing a stabilizer unit capable of maintaining the tremolo bridge 26 in that position but allowing for actuation of the tremolo bridge in response to the tremolo arm; and actuating the stabilizer to limit unwanted movement of the tremolo arm in the event of string failure, so as to permit continued playing of the instrument.

The present invention may be embodied in other specific forms without departing from its spirit or essential attributes. According, reference should be made to the appended claims rather than to the foregoing specification as indicating the scope of the invention.

I claim:

1. A stabilizer for a tremolo device of the type having a tremolo bridge plate movably coupled to the body of an instrument, strings coupled to the bridge plate, spring means coupled to the bridge plate and opposing the tension of the strings and a tremolo actuator coupled to the bridge plate, said stabilizer comprising: an abutment operatively associated with the bridge plate, said abutment having a first inoperative position and a second operative position in which it stabilizes the bridge plate by limiting movement of the bridge plate in one direction in response to the spring means, means coupled to said abutment for maintaining said abutment in said first position, means coupled to said abutment for moving said abutment from said first to said second position, and means for maintaining said abutment in said first position comprising selectively operable latch means coupled to said abutment, whereby operation of said latch means enables said abutment to move from said first to said second position, said abutment and said latch means being coupled to said bridge plate for movement therewith.

2. Apparatus in accordance with claim 1, and a limit stop coupled to said bridge plate for movement therewith, said abutment having thereon means engagable with said limit stop to maintain said abutment in said second position.

3. Apparatus in accordance with claim 1 wherein said abutment comprises a pin member slidably mounted with respect to said bridge plate from said first to said second position, and a stop bolt operatively associated with said pin, said stop bolt being selectively adjustable with respect to said pin to determine the position of said bridge plate when said abutment is in said second position.

4. Apparatus in accordance with claim 3, and a striker plate on the body of the instrument, said striker plate being juxtaposed to and engagable with said stop bolt when said abutment is in said second position.

5. Apparatus in accordance with claim 3, and a limit stop coupled to said bridge plate for movement therewith, said abutment having a theron means engagable with said limit stop to maintain said abutment in said second position.

6. Apparatus in accordance with claim 5, and a striker plate on the body of the instrument, said striker plate being juxtaposed to and engagable with said stop bolt when said abutment is in said second position.

7. A method for stabilizing a bridge of a tremolo device associated with a stringed instrument, comprising the steps of tuning the instrument, determining the position of the tremolo bridge in a normal position with the strings tuned, all strings intact and the tremolo inactive, providing a stabilizer for the bridge capable of maintaining the bridge in said position in the event of failure of a string while still allowing actuation of the tremolo device, adjusting the stabilizer to a configuration in which the stabilizer is capable of maintaining the bridge in said position, moving the stabilizer to a retracted position in which the stabilizer is inactive, and selectively moving the stabilizer to an operative position, in which the stabilizer maintains the bridge in said position, in response to failure of a string.

8. A stabilizer for a tremolo device of the type having a tremolo bridge plate movably coupled to the body of an instrument, strings coupled to the bridge plate, spring means coupled to the bridge plate and opposing the tension of the strings and a tremolo actuator coupled to the bridge plate, said stabilizer comprising: an abutment operatively associated with the bridge plate, said abutment having a first inoperative position and a second operative position in which it stabilizes the bridge plate by limiting movement of the bridge plate in one direction in response to the spring means, means coupled to said abutment for maintaining said abutment in said first position, means coupled to said abutment for moving said abutment from said first to said second position, and means for maintaining said abutment in said first position comprising selectively operable trigger means coupled to said means for maintaining said abutment in said first position, whereby operation of said trigger means causes said abutment to move rapidly from said first to said second position.

* * * * *